US009891588B1

(12) United States Patent
Garcia

(10) Patent No.: US 9,891,588 B1
(45) Date of Patent: Feb. 13, 2018

(54) LINEAR CLOCK

(71) Applicant: Christopher George Garcia, Richardson, TX (US)

(72) Inventor: Christopher George Garcia, Richardson, TX (US)

( * ) Notice: Subject to any disclaimer, the term of this patent is extended or adjusted under 35 U.S.C. 154(b) by 0 days.

(21) Appl. No.: 15/251,461

(22) Filed: Aug. 30, 2016

(51) Int. Cl.
*G04G 9/00* (2006.01)
*G04B 19/22* (2006.01)
*G04B 19/20* (2006.01)

(52) U.S. Cl.
CPC ..... *G04B 19/228* (2013.01); *G04B 19/207* (2013.01); *G04G 9/0082* (2013.01)

(58) Field of Classification Search
CPC .... G04B 19/228; G04G 9/0082; G04G 9/042; G04G 9/062
See application file for complete search history.

(56) References Cited

U.S. PATENT DOCUMENTS 3,574,992 A * 4/1971 Ladas ..... G04G 9/04 368/234
4,068,465 A * 1/1978 Bacon ..... G04G 5/04 368/188
4,370,068 A * 1/1983 Han ..... G04G 9/02 368/240
5,896,348 A * 4/1999 Lyon ..... G04G 9/02 368/223
6,256,265 B1 * 7/2001 Sepulveda ..... G04G 9/06 368/239
6,628,571 B2 * 9/2003 Emami ..... G04B 19/00 368/223
7,835,231 B1 * 11/2010 Garcia ..... G04G 9/042 368/223
2006/0256663 A1 * 11/2006 Sela ..... G04G 9/06 368/62

* cited by examiner

*Primary Examiner* — Edwin A. Leon
*Assistant Examiner* — Jason Collins
(74) *Attorney, Agent, or Firm* — Jeffrey Roddy

(57) ABSTRACT

A linear clock and method of indicating the time includes twelve linearly arranged regions wherein each region includes an indicator termed a "marker," which is capable of representing a unique hour with a twelve hour cycle or a block of time equal to a five minute increment. Interspersed with the twelve linearly arranged regions is a group of four indicators that are capable of representing a one-minute increment and collectively, up to four minutes.

19 Claims, 12 Drawing Sheets

LINEAR CLOCK

BACKGROUND OF THE INVENTION

Technical Field

This invention relates to timepieces, and more particularly, to an electrical device for displaying time.

Description of Related Art

The history of clocks is very long, and there have been many different types of clocks over the centuries. The first way that people could tell the time was by looking at the sun as it crossed the sky. When the sun was directly overhead in the sky, it was the middle of the day, or noon. When the sun was close to the horizon, it was either early morning (sunrise) or early evening (sunset). The oldest type of clock is a sundial clock, also called a sun clock. They were first used around 3,500 B.C. The next great advance in timekeeping occurred in about 3450 B.C. when a primitive hourglass was invented. This device was basically a bowl with a hole in the bottom. Water dripped through the hole slowly as the day wore on and grooves cut into the side of the bowl measured the passage of time. The hour glass had many advantages over sundials, because they would work on cloudy days and at night.

The Greeks divided the year into twelve parts that are called months. They divided each month into thirty parts that are called days. Their year had a total of 360 days, or 12 times 30 (12 times 30=360). Since the Earth goes around the Sun in one year and follows an almost circular path, the Greeks decided to divide the circle into 360 degrees. The Egyptians and Babylonians decided to divide the day from sunrise to sunset into twelve parts that are called hours. They also divided the night, the time from sunset to sunrise, into twelve hours. Twelve is about the number of moon cycles in a year, so it is a special number in many cultures. The hour is divided into 60 minutes, and each minute is divided into 60 seconds. The idea of dividing the hour and minute into 60 parts comes from the Sumerian sexagesimal system, which is based on the number 60. This system was developed about 4,000 years ago. The first practical clock was driven by a pendulum. It was developed by Christian Huygens around 1656. By 1600, the pendulum clock also had a minute hand. One problem with pendulum clocks is that they stopped running after a while and had to be restarted. The first pendulum clock with external batteries was developed around 1840. By 1906, the batteries were inside the clock.

Quartz crystal clocks were invented in 1920. Quartz is a type of crystal that looks like glass. When you apply voltage or electricity and pressure, the quartz crystal vibrates or oscillates at a very constant frequency and the vibration moves the clock's hands very precisely. The next great advancement in timekeeping was in 1967 when the atomic clock, which used the oscillations of cesium-133 atoms, was developed to precisely to tell time. Almost all clocks use a round face to display the time.

In a departure from the foregoing, U.S. Pat. No. 7,835,231 to Garcia describes a linear clock with a stacked arrangement of indicators that show a unique hour section, a unique five-minute section and unique one-minute section.

While the foregoing patent describes a vastly different apparatus and method of showing time than past art, it would be desirable to provide improvements to a linear clock providing a fully functioning clock capable of displaying hours, five-minute blocks and up to four one-minute increments that is more minimal in structure, and simpler in apparent operation.

SUMMARY OF INVENTION

The present invention provides a device and method that uses a linear scale to determine the time. In general, the linear clock is divided into twelve regions wherein each region includes one indicator referred to herein as a "marker," which is capable of representing a unique hour within a twelve hour cycle or a block of time equal to a five-minute increment. Also interspersed within the regions is a group of four indicators referred to herein as "one-minute indicators" which are each capable of representing a one-minute increment, and collectively, up to four minutes. In general, the markers are placed in a series, one after the other in an alternating sequence. Typically the displayed hour corresponds numerically to the position of an activated marker. For example, 4 o'clock or 5 o'clock may be displayed by activating respectively, the fourth marker or fifth marker from any end of the clock. While typically the hours are counted from the bottom end where the orientation of the clock is vertical, orientation may be altered from vertical to horizontal. In some cases, the hour may be shown as an aggregate of one or more markers. In cases where the time to be shown includes intervening minutes between hours, and wherein the total number of minutes are divisible by five, one marker may be configured to show the hour and one or more markers configured to display one or more five-minute block(s) of time. When displayed by the markers, the hour and five-minute increment(s) are distinguishable from one another by color, intensity, pulsation or some other visually discernible characteristic. In cases where the total minutes are not divisible by five, the linear clock displays a combination of at least one activated marker configured to display an hour, and at least one one-minute indicator. For example 2:04 would display the second marker as (hour 1) from the bottom of the linear clock and the fourth one-minute indicator as (minute 4) from the bottom of the linear clock. Alternately, the time may be shown in aggregate wherein the linear clock displays plural activated markers, such that the hour is obtained by displayed plural hours, at least one one-minute indicator, and activated markers indicating five minute blocks of time as required to accurately depict the time.

While the invention is directed primarily to an apparatus for displaying time in a particular manner and associated methods and not a particular electronic circuit, persons having skill in the art and access to this disclosure will appreciate that activation of the appropriate markers to display instant time vis-a-vis the display of the appropriate hour or the display of a five-minute block, and/or activation of the one-minute indicators to display the odd number of minutes after an hour, may be accomplished by any number of known methods, e.g., by obtaining the instant time by polling a clock or timer circuit that may contain a readily available timer integrated circuit (IC) such as the 74HC14, the MM5387, or the DS1307 wherein at least the hours and minutes may be polled and programmable logic used to activate the markers and one-minute indicators. By way of example and not limitation, one high level control flow diagram is depicted in FIG. 20.

In one aspect of the present invention, a first mode of display referred to herein as minimal mode, represents the time according to the relative position of activated indicators, whether markers or one-minute indicators. In such cases, the time of 8:15 would be represented by activating the eighth marker counting from the beginning of the series, designating the eighth hour, and activating the third marker from the beginning of the series which designates 15 minutes; (5+5+5). In such cases, one non-limiting means to distinguish the hour and five-minute block which are both displayed by the markers is by color, brightness or border appearance.

In another aspect of the present invention, a second mode of display referred to herein as aggregate mode, represents the time according to the aggregate number of activated indicators, whether markers or one-minute indicators. In such cases, the time of 8:17 may be represented by activating the first eight markers starting at the beginning of the series which designates eight hours, activating the first three markers counting from the beginning of the series to display five-minute blocks (5+5+5), and, activating the first two one-minute indicators counting from the beginning of the series.

In whatever mode, the indicators representing one-minute increments may be visually distinguishable from the markers that are capable of representing either a unique hour or one or more five-minute blocks, by color, light intensity, border appearance, size or shape. At certain times the displayed hour and a five minute block may share the same location in the series. At such times, the particular activated marker representing both an hour and a five-minute block may be displayed by combining colors which at other times represent exclusively hours or five-minute blocks. In one non-limiting example, in cases where the hour mode color is red and the five-minute block mode is blue the marker in a combined mode may turn purple. By way of example and not limitation, for the time of 2:05, the second marker from the beginning of the series may display red, and the first marker from the beginning of the series may display blue, while the one-minute indicators are inactivated or blank. At 2:06 the one-minute indicator residing within bounds of the second marker is displayed with the same color as the five-minute display, i.e., blue. When the time transitions to 2:10, all one-minute indicators are switched off, while the second marker from the beginning of the series combines the blue of the five-minute blocks and red for the hours to display purple.

In some embodiments the device may be mounted on a wall, ceiling, or free standing. In another embodiment, the device may be worn as jewelry on the wrist (FIGS. 14 and 15), draped around the neck or hanging from a chain around the neck, or attached to an article of clothing. In yet another embodiment, the device is flexible and may be shaped into a curved or other aesthetically pleasing pattern. In yet another embodiment, the device may be mounted on, or incorporated into the side of a building or large structure. In yet another embodiment, the device may be incorporated in a portable electronic device as a means for displaying time. In some embodiments the linear clock of the invention may be projected onto a medium such the earth, brick, stone or wood, wall board, a screen, canvas, glass, a waterfall, a mist or vapor. In some embodiments the time may be displayed by manually swapping out or interchanging one or more markers or one-minute indicators within the twelve regions.

In some embodiments, a substrate adjacent the markers and one-minute indicators is an LCD that is supported by a wall or is attached to a rigid or relatively rigid material. It should be understood that such a substrate may have almost any profile that will accommodate the markers, and one-minute indicators. In some embodiments, the substrate may be a single sheet of transparent or translucent material that is illuminated. By way of example and not of limitation, markers, and one-minute indicators may be made of plate glass, plastic, acrylic or some other material that can carry light or illumination and/or allow for an edge-lit effect. In some embodiments markers and one-minute indicators may be displayed in an electronic paper display (EPD).

Each marker is activated at the appropriate time. For example, at 1 o'clock, the marker in the 1 o'clock position; first from the bottom is activated. By way of example and not of limitation, activation may include an LED light, light bulb, neon, or some other illumination source. In one embodiment, markers may be transparent or translucent such that upon activation, at least a portion of the appropriate marker glows or is illuminated. The color or visual appearance of an marker may be the same, or different for each marker or may change over the hour such that during the hour a specific marker is activated its appearance changes. As time passes, each marker that was previously illuminated may remain illuminated, blink, dim, pulse or may not be illuminated at all.

It should be understood that while the in the particular embodiments described herein, hours of a day are counted from the bottom of the linear clock, as described previously, hours may be counted starting from the top, and it is conceivable that day and night times may be differentiated by the direction that hours are counted.

REFERENCE LISTING

Figure 1:
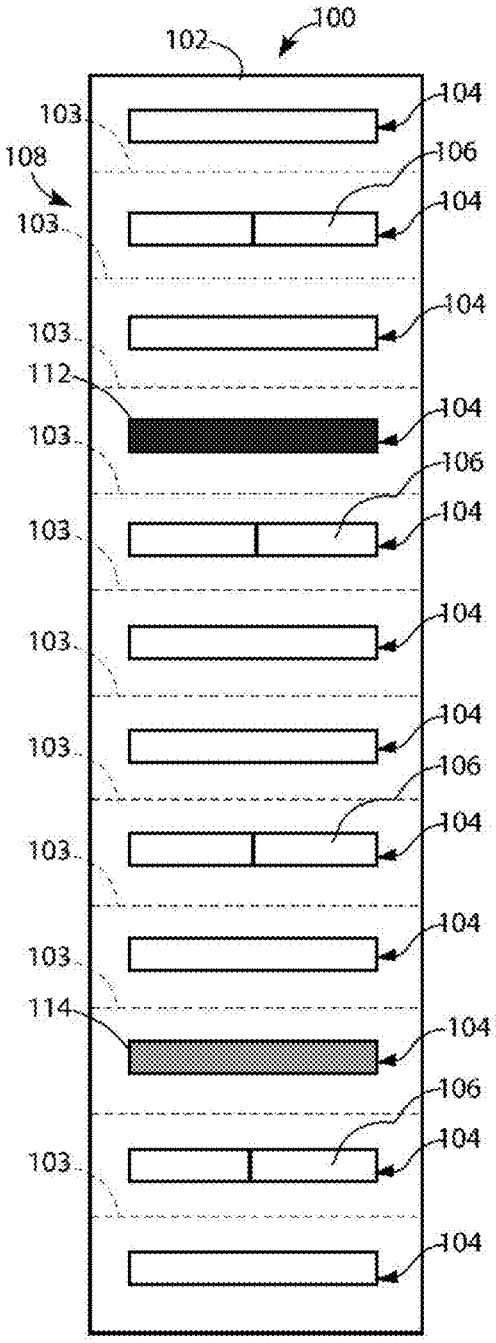
FIG. 1 is an exemplary plan view of a linear clock in accordance with an embodiment of the present invention displaying the time of 9:15.

100 linear clock
102 substrate
103 region
104 hour and five minute block marker
106 one-minute block indicator member
108 minimal mode
110 aggregate mode
112 hour display
114 five-minute block display
116 combined hour and five-minute block mode

DETAILED DESCRIPTION OF THE INVENTION

In the following description, the term "marker" refers generally to a visually distinguishable indicator, sign or symbol that may change in response to automated timekeeping means such as a timer circuit, or, may be manually changed by a user. The term "marker" refers to an "hour or five-minute block indicator" which has an exclusive hour mode, an exclusive mode for five-minute blocks and in some cases, a combined mode. The term "one-minute indicator" means an indicator that is part of a group of indicators capable of displaying exclusively one-minute increments up to a total of four minutes. Markers may "toggle" from one mode to another to designate a unique hour of the day, or designate one or more five-minute blocks of time. For example, a marker may display a particular color to indicate a unique hour, and display another color to indicate a five-minute block. In minimal or positional mode, time in hours is read depending on the position of a single activated marker in reference to other adjacent markers. Time in minutes is shown either by the relative position of markers while in five-minute block mode, or in cases where the number of minutes to be shown is not evenly divisible by five-minute increments, the relative position of displayed one-minute indicators. In aggregate or cumulative mode, time shown depends on the number of activated marker(s) and, in cases where the number of minutes to be shown is not evenly divisible by five-minute increments, the aggregate of displayed minute indicators. At certain times, e.g., 2:10, 4:20, etc., the marker corresponding to the hour may be required to represent both hours and one or more five-minute blocks. In such cases, the marker may still show only one color but behave in a predetermined fashion, e.g., blinking, pulsing. Alternately, the marker may display combinations of color, etc., that distinguish collocated hour displays and one or more five-minute block displays. The term "substrate" refers to any non-indicator area surrounding the markers which may be any surface to which the marker and indicators are attached, a surface on which the markers and indicators are resting or a surface on which the markers and indicators are displayed. It should be understood that descriptions herein of apparatus and method are intended to exclude time keeping devices with swept hands.

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. It should be understood that the objects, features and aspects of any embodiment disclosed herein may be combined with any object, feature or aspect of any other embodiment without departing from the scope of the invention. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Figure 2:
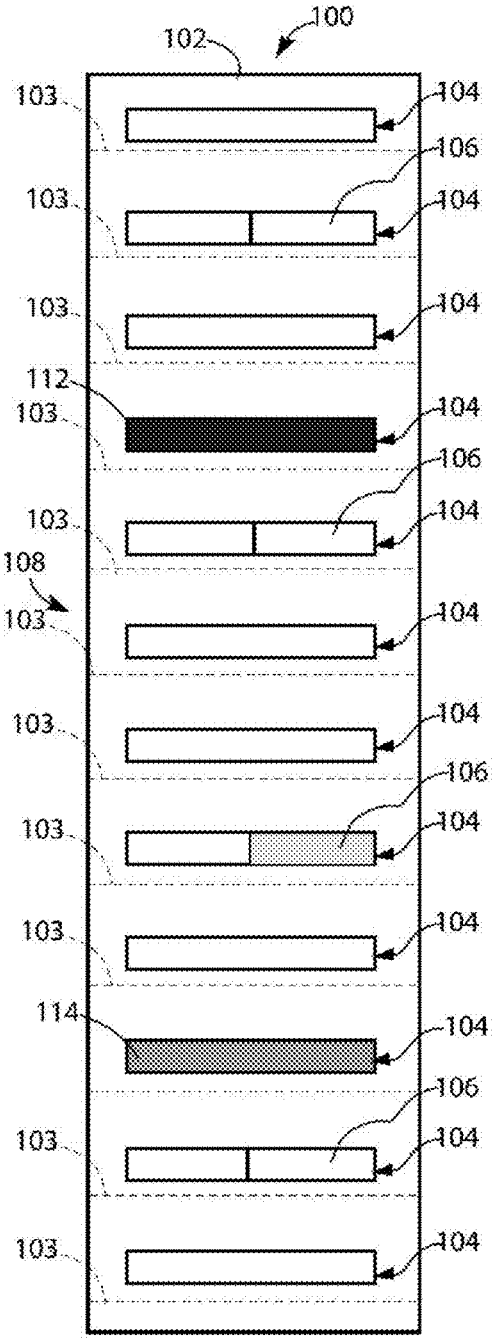
FIG. 2 is an exemplary plan view of a linear clock in accordance with an embodiment of the present invention displaying the time of 9:17.
Figure 3:
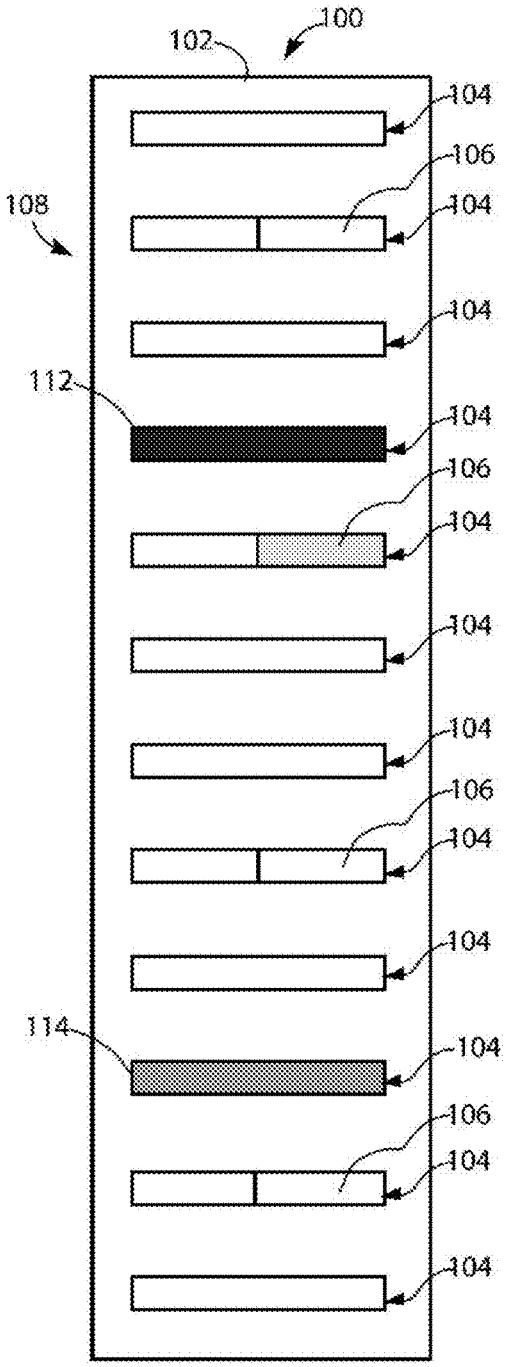
FIG. 3 is an exemplary plan view of a linear clock in accordance with an embodiment of the present invention displaying the time of 9:18.
Figure 4:
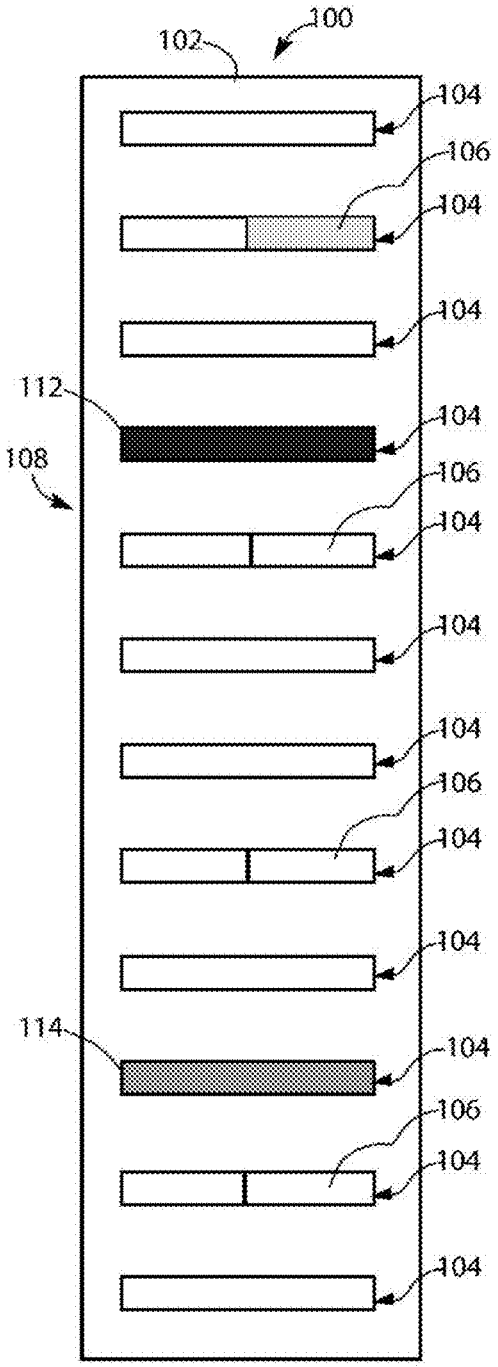
FIG. 4 is an exemplary plan view of a linear clock in accordance with an embodiment of the present invention displaying the time of 9:19.
Figure 5:
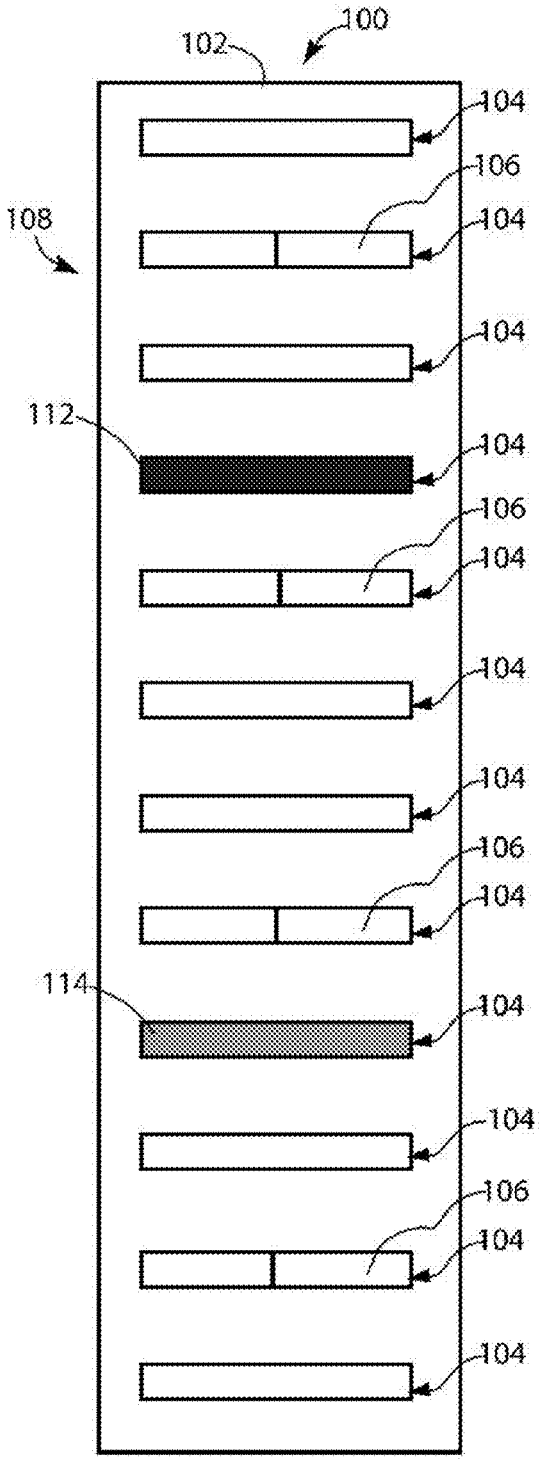
FIG. 5 is an exemplary plan view of a linear clock in accordance with an embodiment of the present invention displaying the time of 9:20.
Figure 6:
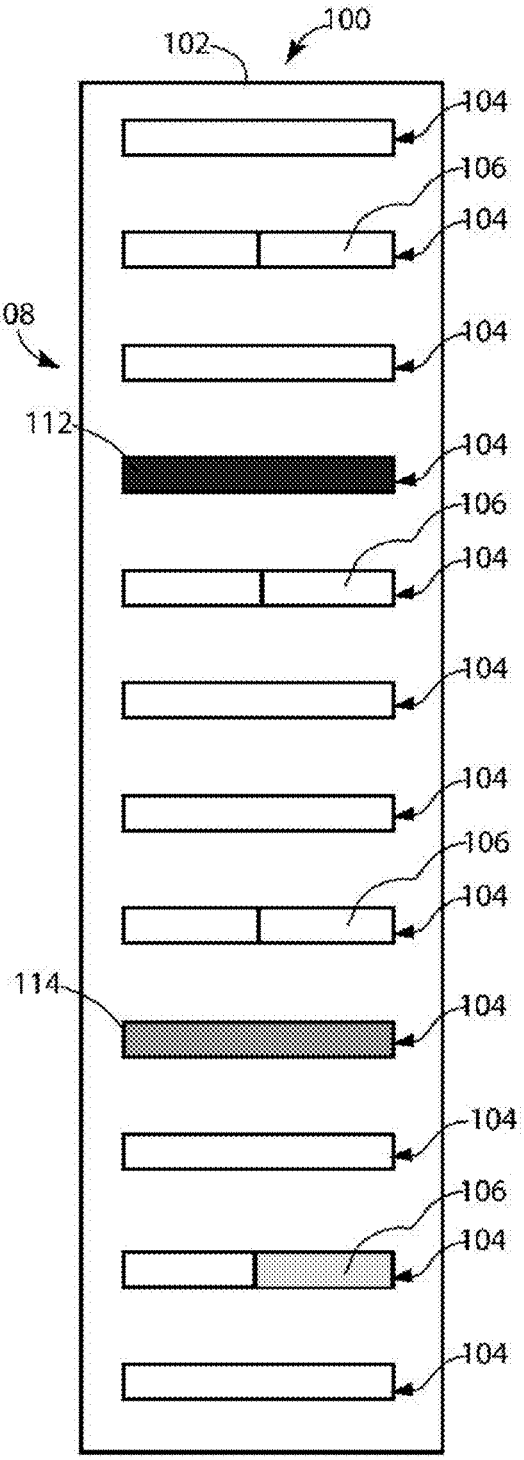
FIG. 6 is an exemplary plan view of a linear clock in accordance with an embodiment of the present invention displaying the time of 9:21.
Figure 7:
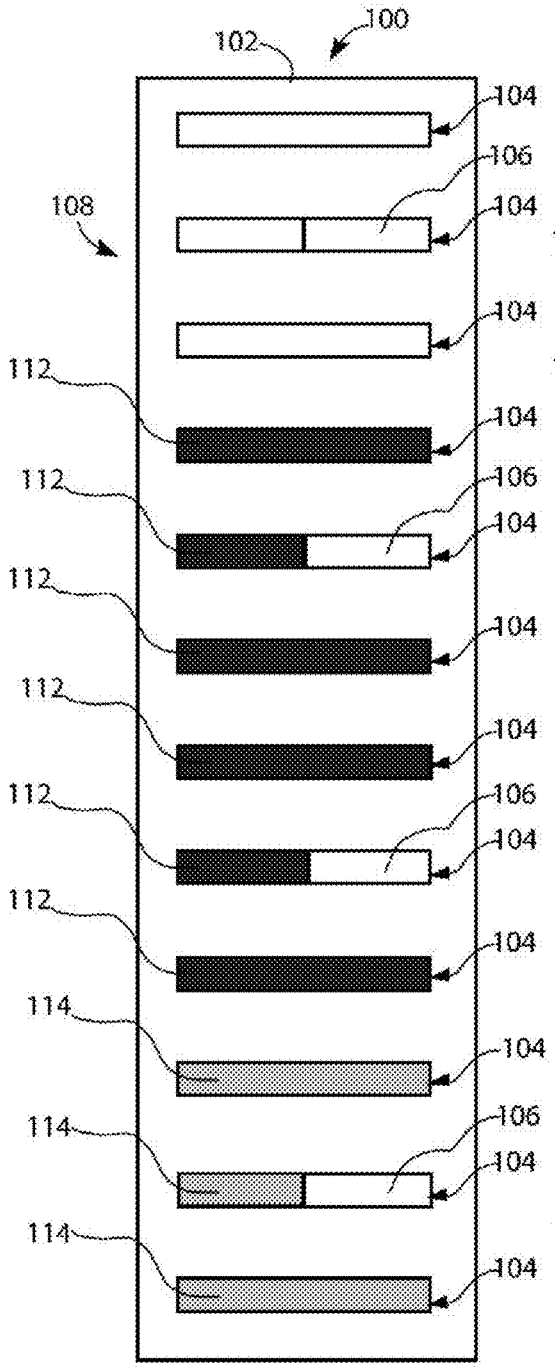
FIG. 7 is an exemplary plan view of a linear clock in accordance with an embodiment of the present invention displaying the time of 9:15.

Referring generally to FIGS. 1-19, a linear clock 100 is divided logically into twelve regions 103, and includes a substrate 102, and a group of twelve markers 104 wherein each member of the group of twelve markers is capable of representing a unique hour or one or more five-minute block(s) of time. As best depicted in FIGS. 1 and 2, the division of the linear clock into twelve regions typically includes twelve evenly spaced regions where the first and last regions may occupy relatively more or less area than the remaining regions. Markers 104 are arranged in sequence over the substrate 102 that may include a mounting board housing electronics controlling the linear clock, or any surface adjacent to the markers. The linear clock also includes a group of four one-minute indicators 106 wherein each one-minute indicator is located within the boundary of one of the twelve regions, and wherein each one-minute indicator can represent one to four minutes. In some embodiments, the markers and one-minute indicators are controlled by a controller that controls LEDs that illuminate markers/indicators 104, 106. As will be appreciated by those skilled in the art, the programming for the controller may written in assembly, C or a higher level language to drive the controller.

Referring to FIGS. 1-6, the linear clock 100 may operate in minimal mode 108 wherein time is read based on the relative position of the markers and one-minute indicators 106 within the series of markers. FIG. 1 illustrates the linear clock 100 in minimal mode 108 displaying the time of 9:15. The marker ninth in position from the bottom is activated concurrently with the marker third in position from the bottom. Markers 104 may include an hour mode 112 and a five-minute block mode 114 distinguishable by color. In such as case, an observer would know that the clock reads 9:15 instead of 3:45 by using predetermined colors to designate hours and five-minute blocks. At times when the location of a displayed hour and one or more five-minute block(s) overlap, the marker may have a combined mode that displays alternating colors, combinations of colors or display another behavioral indicator for the collocated hours and one or more five-minute block(s). FIG. 2 illustrates the linear clock 100 in minimal mode 108 displaying the time of 9:17. The display is the same as in FIG. 1 with the exception that the one-minute indicator second from the bottom is activated. Time is indicated by 9 hours+15 minutes+2 minutes. Once the time transitions to 9:20, FIG. 5, all one-minute indicators are deactivated and the time is shown solely by a single marker 104 ninth in position from the bottom and a single marker 104 fourth position from the bottom in five-minute block mode 114. When the clock transitions to 9:21, FIG. 6, the first one-minute indicator 106 from the bottom, is added to the previous display.

Figure 8:
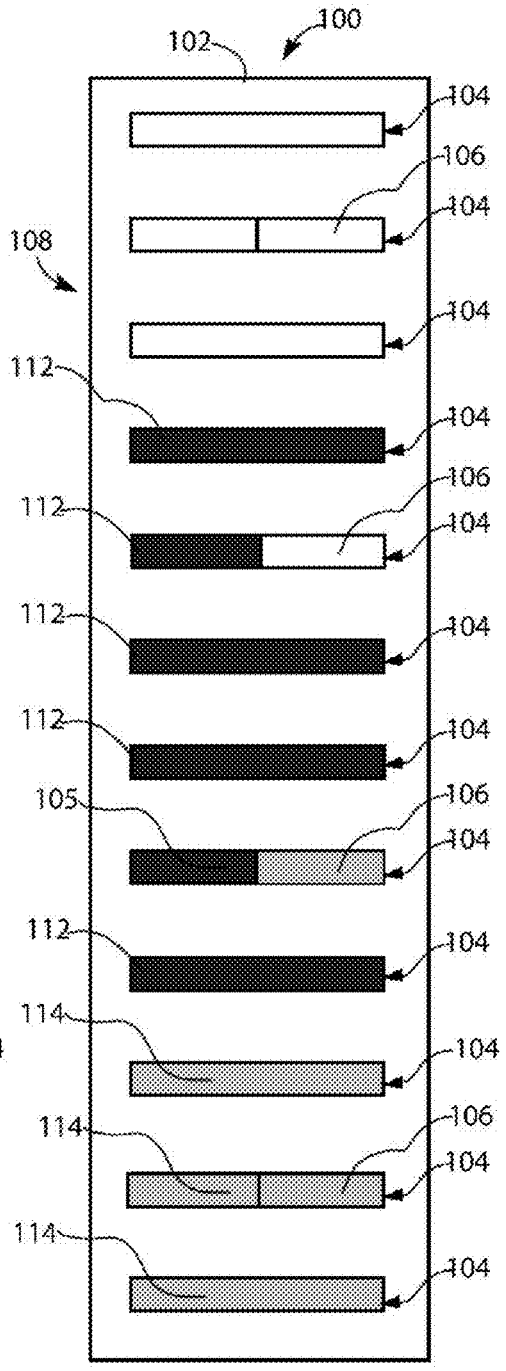
FIG. 8 is an exemplary plan view of a linear clock in accordance with an embodiment of the present invention displaying the time of 9:17.
Figure 9:
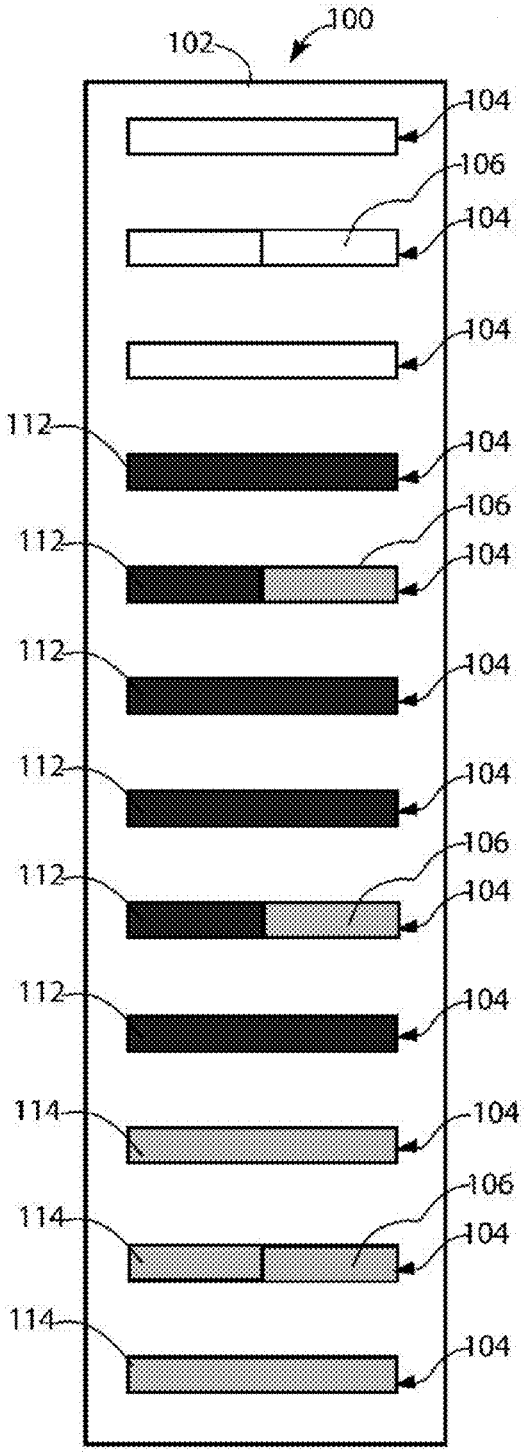
FIG. 9 is an exemplary plan view of a linear clock in accordance with an embodiment of the present invention displaying the time of 9:18.
Figure 10:
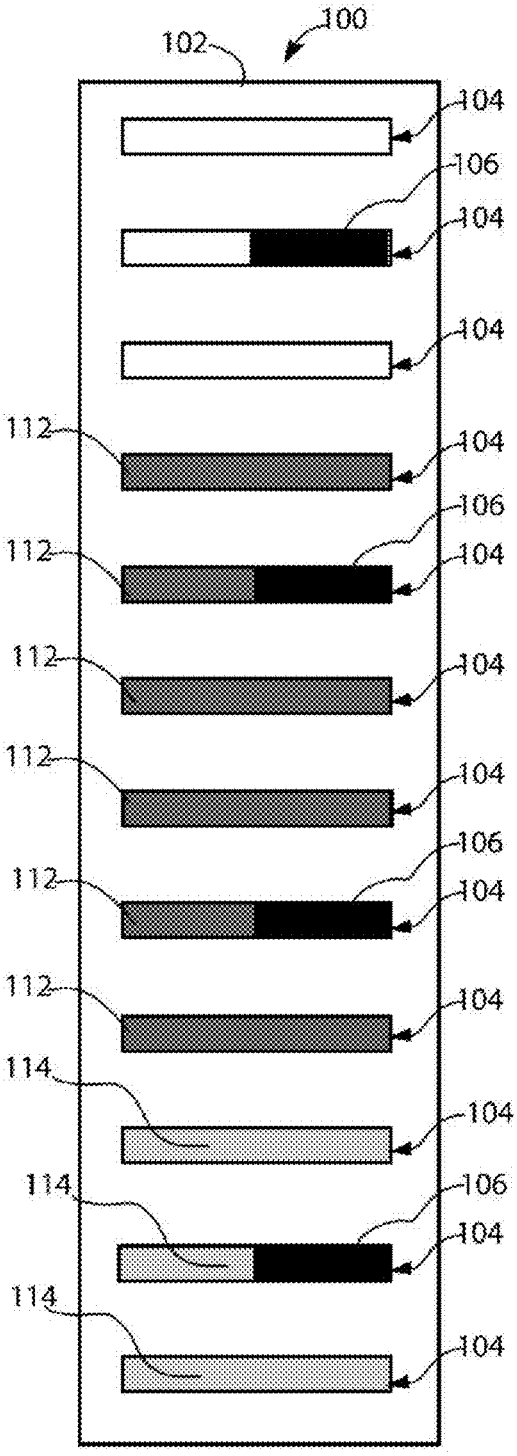
FIG. 10 is an exemplary plan view of a linear clock in accordance with an embodiment of the present invention displaying the time of 9:19.
Figure 11:
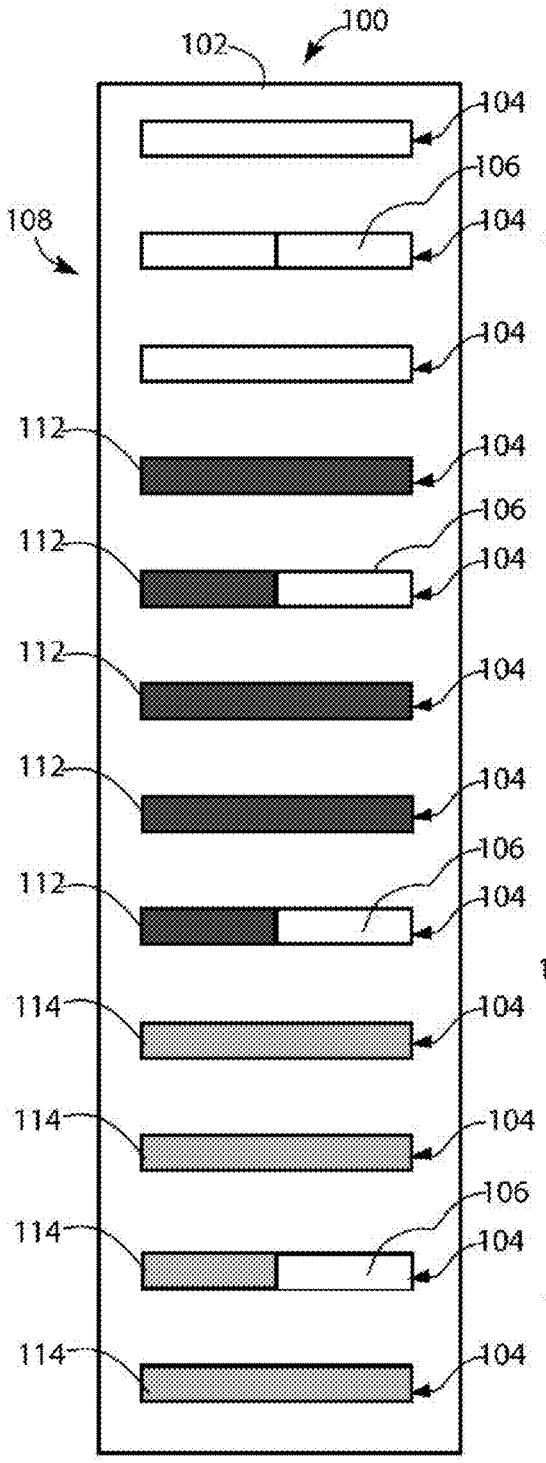
FIG. 11 is an exemplary plan view of a linear clock in accordance with an embodiment of the present invention displaying the time of 9:20.
Figure 12:
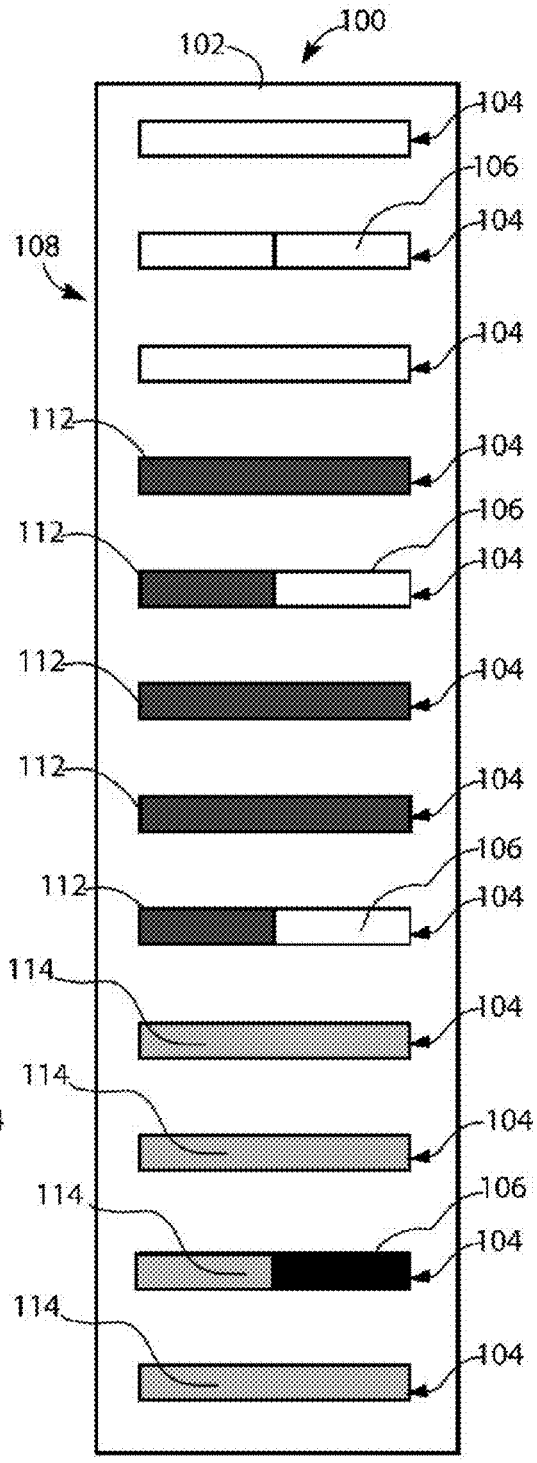
FIG. 12 is an exemplary plan view of a linear clock in accordance with an embodiment of the present invention displaying the time of 9:21.

Referring to FIGS. 7-12, the linear clock 100 is shown in aggregate mode 110 wherein time is read cumulatively based on the number of markers 104 and one-minute indicators 106 simultaneously activated within the entire series of markers and indicators. FIGS. 7-12 show respectively, times 9:15, 9:17. 9:18, 9:19, 9:20 and 9:21. In the particular cases shown, FIGS. 7-9 possess a two color scheme wherein the marker in hour mode displays one color, while the markers in five-minute block mode and the one-minute indicators share a color, and, a three color scheme wherein the markers in hour display mode, the markers in five-minute block mode, and the one-minute indicators have separate group colors or behaviors. Markers in hour mode and in five-minute mode may share a color. In the figures, markers starting from the first at bottom of the linear clock through the ninth marker are activated with one color excepting those displaying five-minute blocks which are also shown collectively starting from the first at bottom of the linear clock. In FIG. 8, displaying the time of 9:17 duplicates the display of FIG. 7 except that the first two one-minute indicators from the bottom are activated, thus adding two minutes to the previous total of fifteen minutes, thereby displaying the time of 9:17.

While each one-minute indicator 106 resides within the boundary of certain regions 102, and may reside within the boundary of a marker 104, it should be understood that the boundary of each one-minute indicator may reside anywhere within the bounds of a region 104; e.g., central position, off to one side, etc. The boundary of each one-minute indicator may or may not be readily discerned from the boundary of the containing region or marker at times when the one-minute indicators are not activated. Alternately, the boundary of each one-minute indicator may be comparatively distinct even when the clock 100 is not operating.

Figure 13:
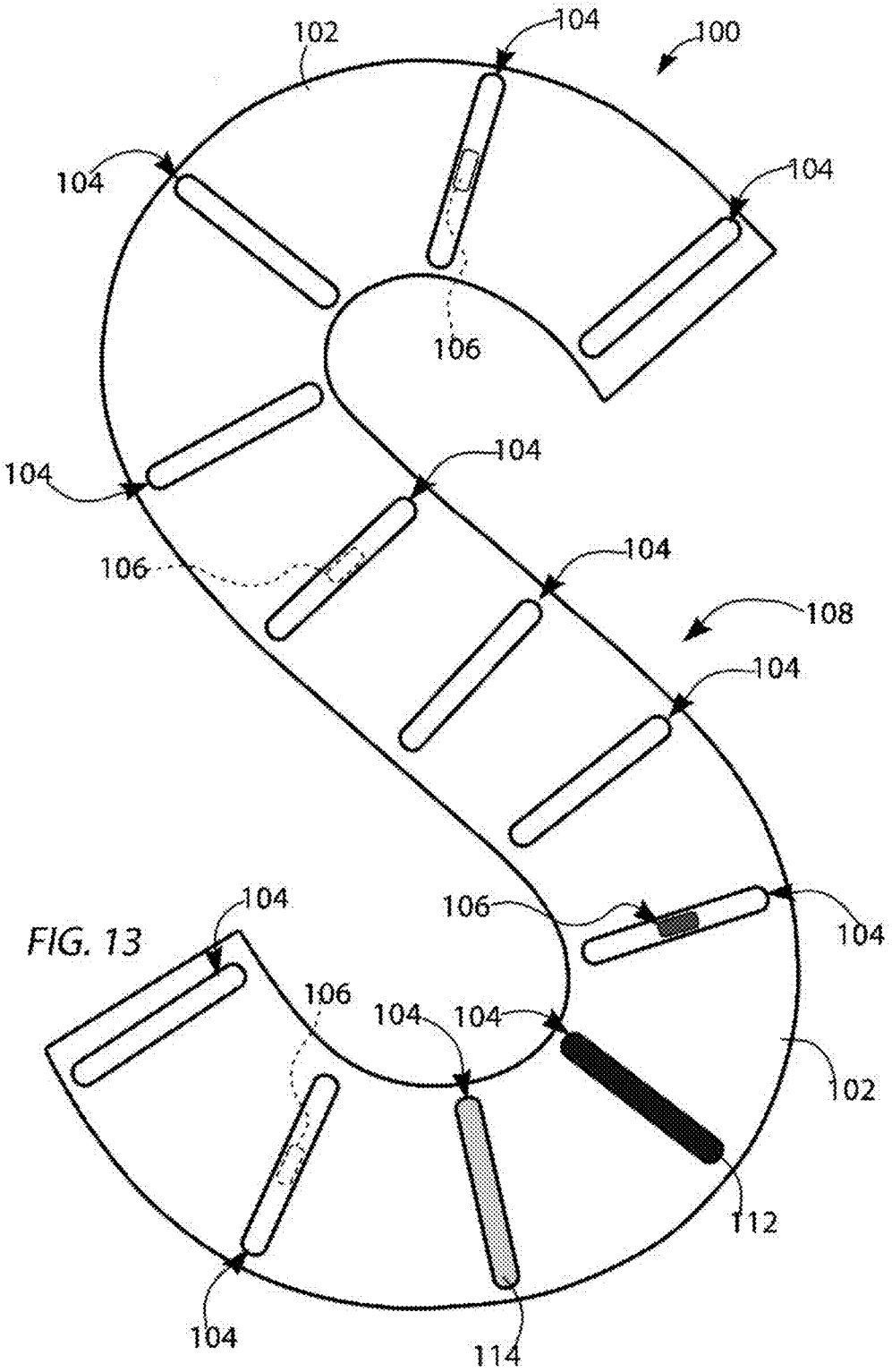
FIG. 13 is an exemplary plan view of a linear clock in accordance with an embodiment of the present invention having a serpentine substrate 102.

FIG. 13 illustrates a embodiment having a serpentine arrangement of indicators wherein the substrate 102 is also serpentine.

Figure 14:
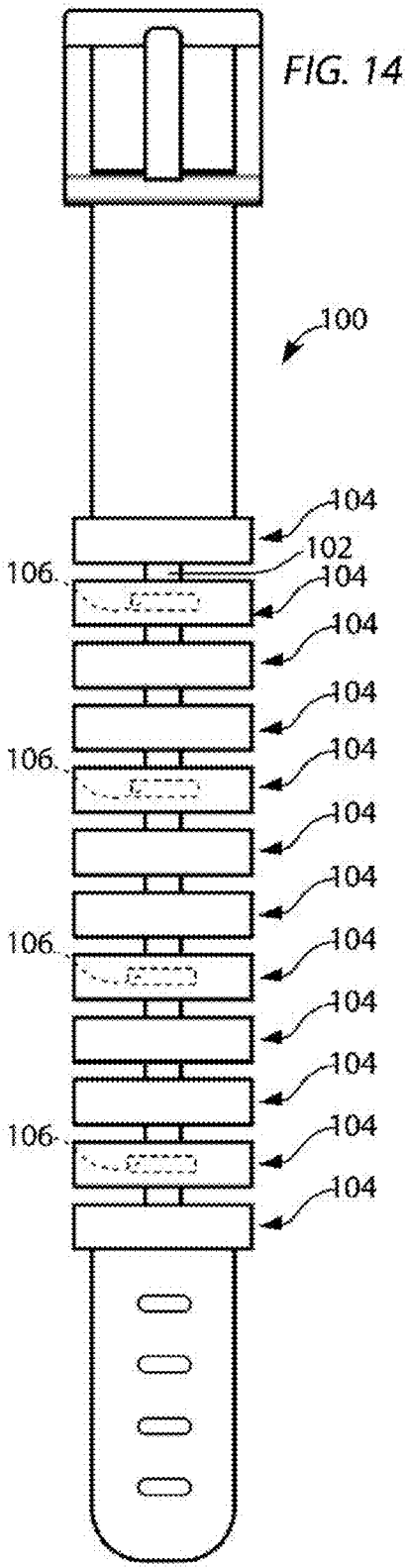
FIG. 14 is a perspective view of a linear clock in accordance with an embodiment of the present invention.
Figure 15:
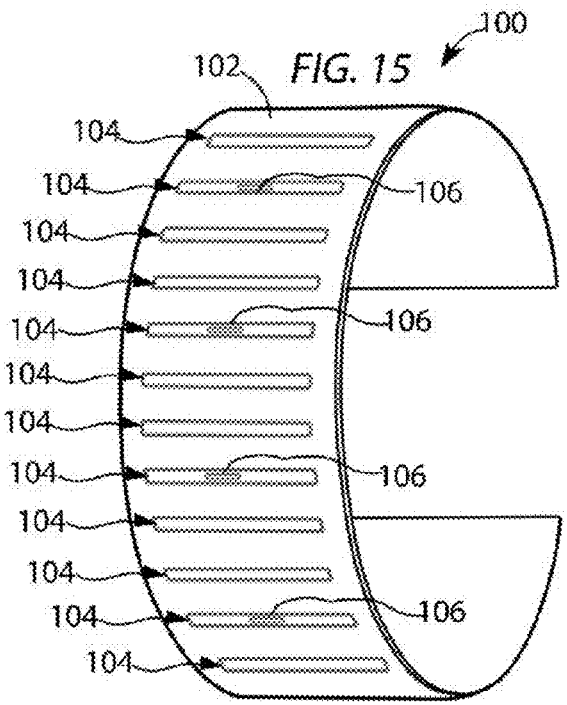
FIG. 15 is a perspective view of a linear clock in accordance with an embodiment of the present invention.

FIGS. 14 and 15 show substrate 102 and indicators (104, 106) embodied in wrist worn timekeeping devices.

Figure 16:
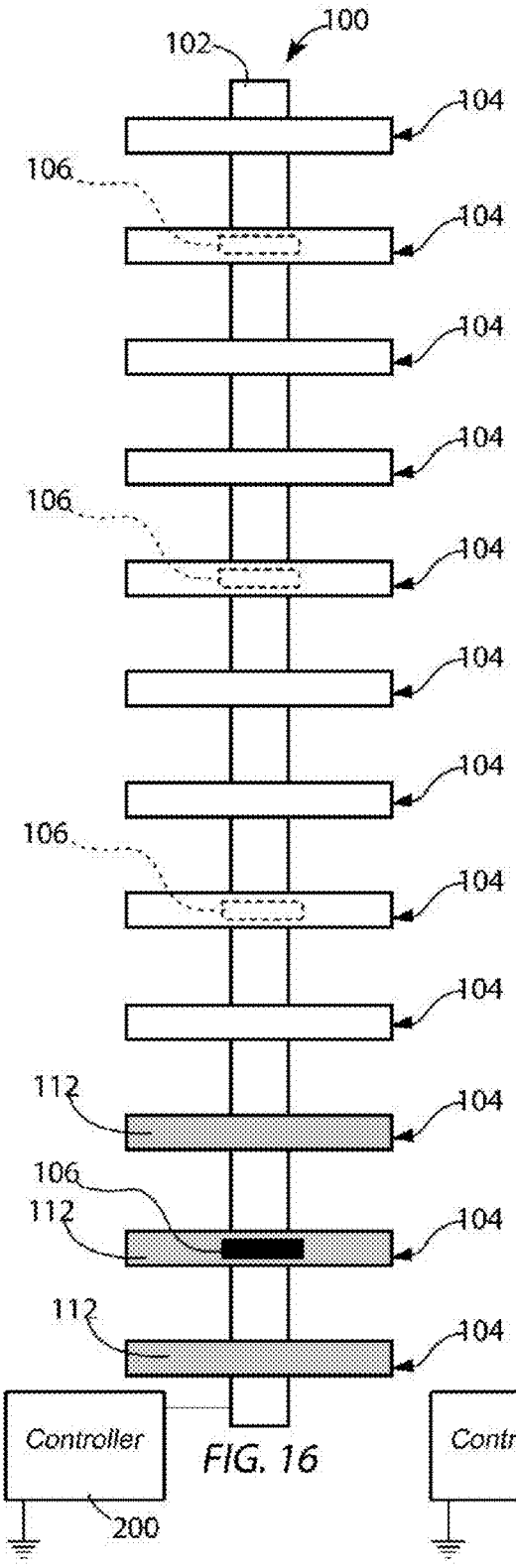
FIG. 16 is a plan view of a linear clock in accordance with an embodiment of the present invention.
Figure 17:
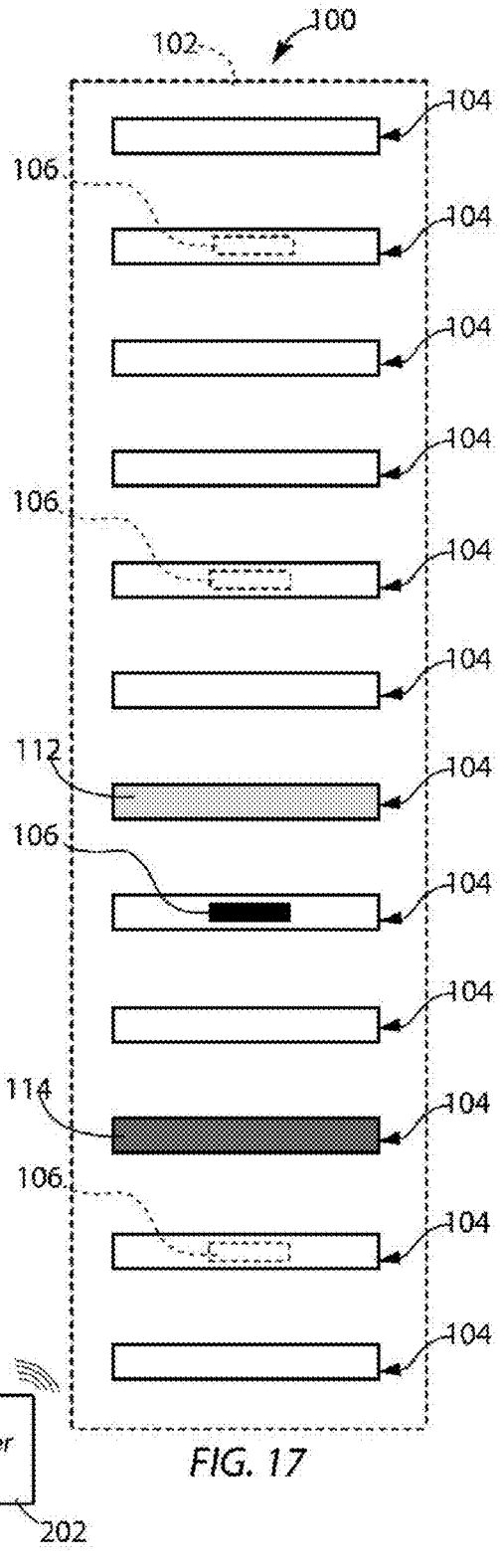
FIG. 17 is a plan view of a linear clock in accordance with an embodiment of the present invention.

FIGS. 16 and 17 show respectively a linear clock including a series of four one-minute indicators, each one-minute indicator residing within one of twelve markers. The first one-minute indicator is within the bounds of the second marker counting from the bottom of the clock, the second one-minute indicator is within the bounds of the fifth marker, the third one-minute indicator is within the bounds of the eighth marker and the fourth one-minute indicator is within the bounds of the eleventh marker. As indicated by the figures, substrate 102 may or may not extend beyond the bounds of the markers. In some embodiments the markers 104 and one-minute indicators 106 may be controlled remotely via radio frequency means such as WiFi or Bluetooth®. In addition, linear clock 100 may be calibrated or set with the radio signals from an atomic clock, a CPU, electronic, mechanical or electromechanical means such as hour and minute set buttons or switches, or by electronics located within or on the substrate 102.

Figure 18:
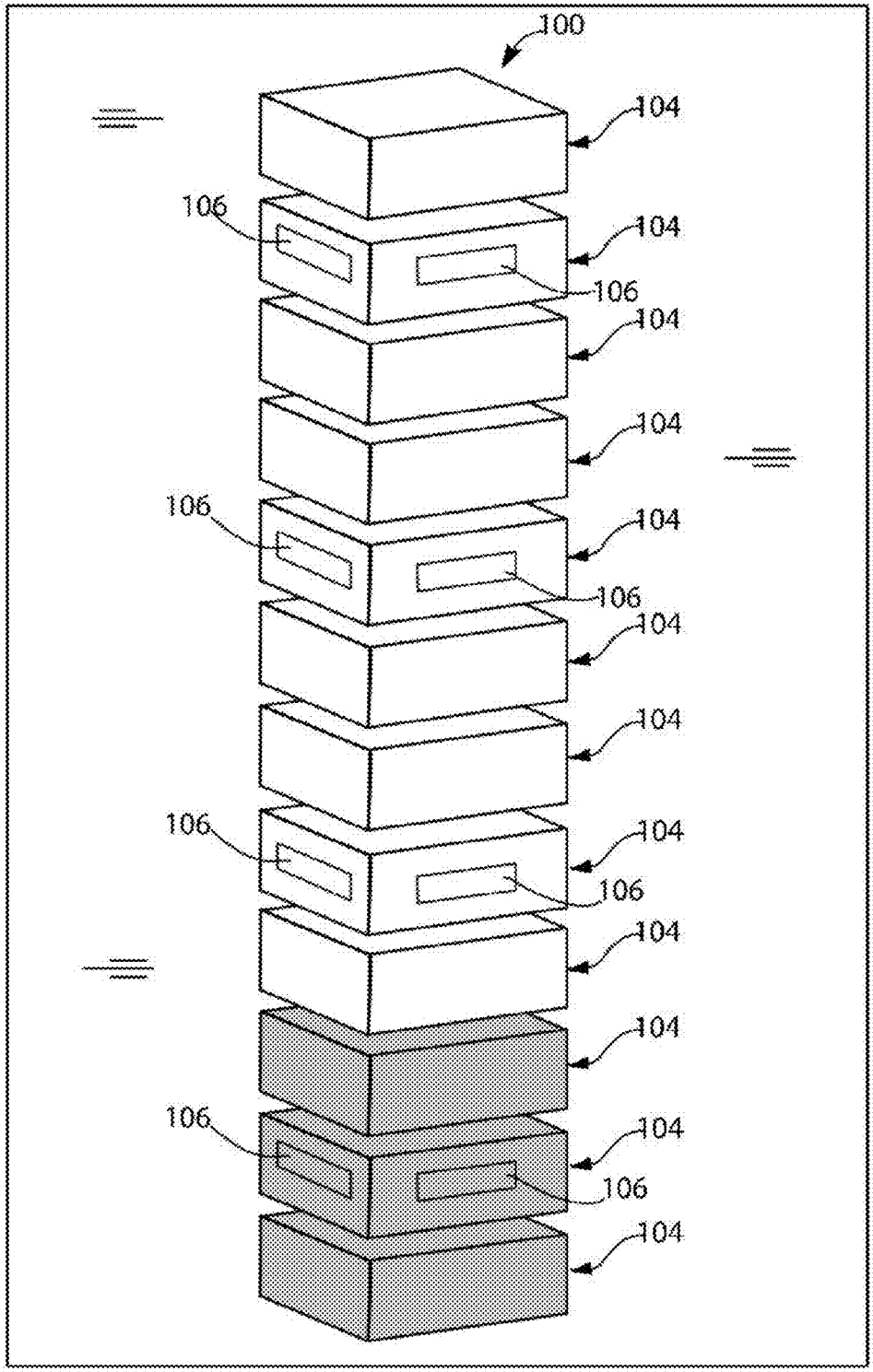
FIG. 18 is a perspective view of a linear clock in accordance with an embodiment of the present invention showing alternating one-minute indicators within bounds of stacked markers 104.

FIG. 18 shows a stacked construction including twelve cubic structures which function as both markers and five-minute block indicators, and four smaller structures spaced equally throughout the twelve structures which function as one-minute indicators. The stacked structure may be free-standing or mounted to a substrate such as a wall.

Figure 19:
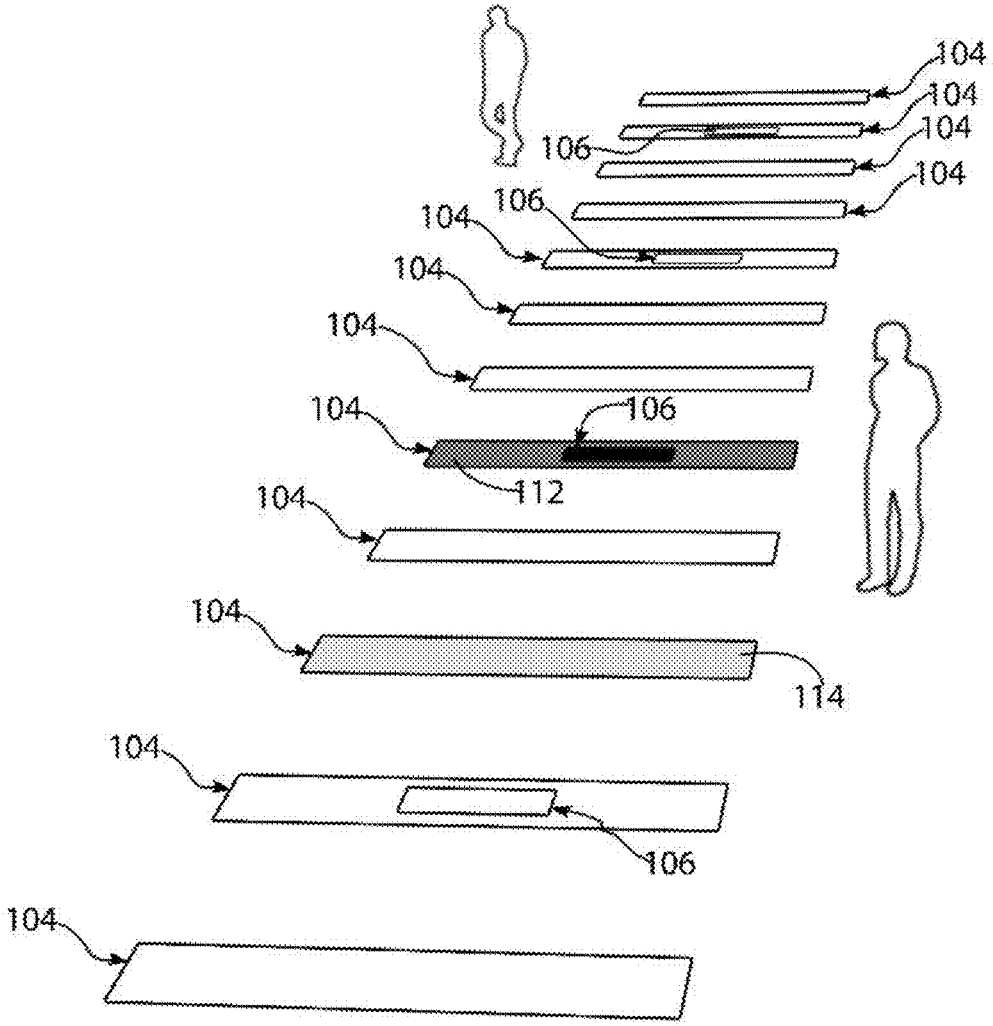
FIG. 19 is a perspective view of a linear clock in accordance with an embodiment of the present invention showing an environmental installation thereof.

FIG. 19 shows an environmental installation wherein markers 104 may be placed on a substrate such as soil, grass or pavement, and wherein control of the indicators may be through a wired timer controller or wherein the indicators are controlled wirelessly by a program running on a CPU.

Figure 20:
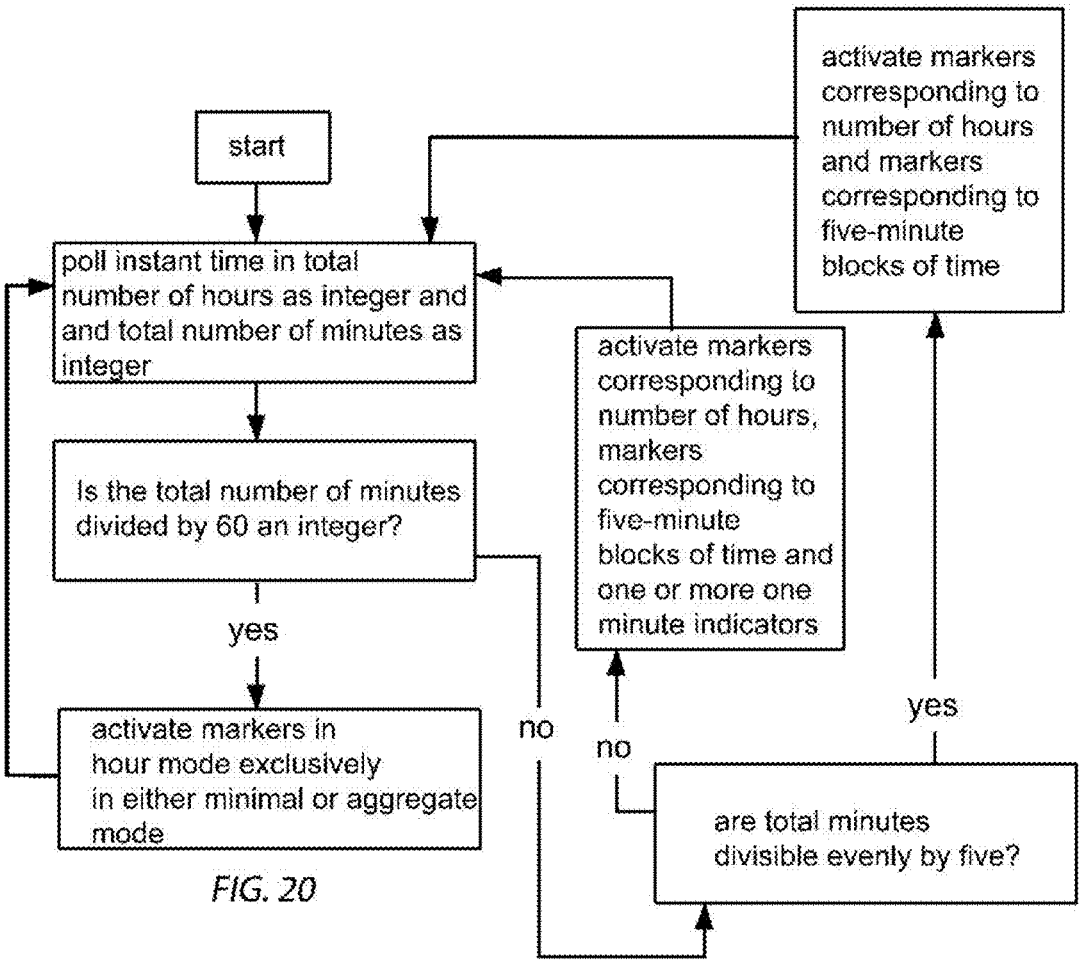
FIG. 20 is an exemplary control flow diagram illustrating a method and device for displaying time.

FIG. 20 is a high level control flow diagram illustrating merely one exemplary process for controlling the linear clock of the present invention.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A linear clock comprising:

(1) a group of twelve regions in a linear disposition, wherein each region includes:

an activatable and deactivateable marker member having a length, a width and a border, and each of the marker members capable of representing a unique hour and one or more blocks of time, and each one of the one or more blocks of time is equal to a five-minute increment;

the linear clock further comprising: a group of four one-minute increment activatable and deactivatable indicator members, wherein one or more of the one-minute increment activatable and deactivatable indicator members are within one or more of the twelve regions; and, each of the marker members includes: at least a first display state showing only the one or more blocks of time, a second display state showing only the unique hour, and a combined display state showing both the unique hour and the one or more blocks of time and wherein the combined display is visually distinguishable from first display state and the second display state.

2. The linear clock according to claim 1, wherein the group of four one-minute increment activatable and deactivatable indicator members can in aggregate, represent up to four minutes.

3. The linear clock according to claim 1, wherein one or more of the twelve regions include a section for one or more members of the group of four one-minute increment activatable and deactivatable indicator members.

4. The linear clock according to claim 1 configured to activate at least one activatable and deactivatable maker member when the linear clock is operating.

5. The linear clock according to claim 1 wherein each member of the group of four one-minute increment activatable and deactivateable indicator members shares a border with one of the twelve regions.

6. The linear clock according to claim 1 including a mode wherein relative position of an activatable and deactivateable marker member within the group of twelve regions indicates the unique hour.

7. The linear clock according to claim 1 including a mode wherein relative position of an activated activatable and deactivatable marker member within the group of twelve regions represents a number of minutes evenly divisible by five-minute increments.

8. The linear clock according to claim 1 including a mode wherein relative position of a single activated member of the group of four one-minute increment activatable and deactivateable indicator members indicates a number of minutes not evenly divisible by five-minute increments.

9. The linear clock according to claim 1 including a mode wherein the unique hour is represented by adding one or more activated members of the activatable and deactivateable marker members.

10. The linear clock according to claim 1 including a mode wherein a number of minutes after an hour which are evenly divisible by five-minute increments, is indicated by adding one or more activated members of the activatable and deactivateable marker members.

11. The linear clock according to claim 1 including a mode wherein a number of minutes after an hour which are not evenly divisible by five-minute increments, is indicated by adding one or more activated members of the group of four one-minute increment activatable and deactivateable indicator members.

12. The linear clock according to claim 1 wherein the unique hour and the one or more blocks of time are visually distinguishable when activated.

13. A method for showing the time of day comprising the steps of:

providing a linear clock with a group of twelve regions in a linear disposition, each region including:

an activatable and deactivateable marker member, each activatable and deactivateable marker member having a length, a width and a border, and each activatable and deactivateable marker member capable of representing a unique hour and one or more blocks of time, and each one of the one or more blocks of time is equal to a five-minute increment;

the linear clock further comprising: a group of four one-minute activatable and deactivateable indicator members wherein one or more of the one-minute increment activatable and deactivateable are within one or more of the twelve regions;

activating at least one of the activatable and deactivateable marker members at all times of the day when the linear clock is operating;

displaying the at least one or more blocks of time within bounds of at least one activatable and deactivateable marker member when minutes to be displayed are evenly divisible by five-minute increments and the minutes to be displayed fall before or after a unique hour;

displaying at least one of the group of four one-minute activatable and deactivateable indicator members when total minutes to be displayed are not evenly divisible by five-minute increments;

configuring the display of the unique hour, the display of the one or more blocks of time, and members of the group of four one-minute activatable indicator members to be visually distinguishable when activated.

14. The method according to claim 13, comprising the step of indicating the unique hour by activating a single displayed member of the activatable and deactivateable marker members.

15. The method according to claim 13, comprising the step of indicating a number of minutes evenly divisible by five-minute increments by activating a single displayed member of the activatable and deactivateable marker members.

16. The method according to claim 13, comprising the step of indicating a number of minutes not evenly divisible by five-minute increments by activating a single displayed member of the group of four one-minute activatable and deactivateable indicator members.

17. The method according to claim 13, comprising the step of indicating a unique hour by displaying one or more activated members of the activatable and deactivateable marker members.

18. The method according to claim 13, comprising the step of indicating a number of minutes evenly divisible by five-minute increments by displaying one or more activated members of the activatable and deactivateable marker members.

19. The method according to claim 13, comprising the step of indicating a number of minutes not evenly divisible by five-minute increments by displaying one or more activated members of the group of four one-minute activatable and deactivateable indicator members.

* * * * *